US011661683B2

(12) United States Patent
Flack et al.

(10) Patent No.: US 11,661,683 B2
(45) Date of Patent: May 30, 2023

(54) FLAME RESISTANT TEXTILE

(71) Applicant: Milliken & Company, Spartanburg, SC (US)

(72) Inventors: Leanne O. Flack, Greer, SC (US); Edward F. Lawrence, Moore, SC (US)

(73) Assignee: Milliken & Company, Spartanburg, SC (US)

( * ) Notice: Subject to any disclaimer, the term of this patent is extended or adjusted under 35 U.S.C. 154(b) by 375 days.

(21) Appl. No.: 16/353,727

(22) Filed: Mar. 14, 2019

(65) Prior Publication Data

US 2019/0301059 A1 Oct. 3, 2019

Related U.S. Application Data

(60) Provisional application No. 62/649,655, filed on Mar. 29, 2018.

(51) Int. Cl.
*D03D 15/513* (2021.01)
*D03D 15/00* (2021.01)

(52) U.S. Cl.
CPC ..... *D03D 15/513* (2021.01); *D10B 2331/042* (2013.01); *D10B 2401/021* (2013.01); *D10B 2501/06* (2013.01); *D10B 2503/02* (2013.01); *D10B 2503/06* (2013.01); *D10B 2505/08* (2013.01)

(58) Field of Classification Search
CPC .... D03D 15/12; D03D 15/00; D03D 15/0027; D03D 1/0035; D03D 2700/0133; D10B 2403/0243; D10B 2501/04; D10B 2501/06; A41D 31/08; A41D 1/00; A62B 17/003
See application file for complete search history.

(56) References Cited

U.S. PATENT DOCUMENTS 4,365,655 A * 12/1982 Feinberg ..... D02G 3/443 139/426 R
4,394,413 A * 7/1983 Westhead ..... D21F 1/0036 139/383 A
7,091,139 B2 * 8/2006 Nobuto ..... B32B 5/26 442/136
7,786,031 B2 * 8/2010 Fang ..... D02G 3/443 442/136
8,193,261 B2 * 6/2012 Lin ..... C08J 3/226 523/351
9,362,725 B2 * 6/2016 Morris ..... H02G 3/0412
9,521,884 B2 * 12/2016 Matsuzawa ..... D03D 15/12
9,988,745 B2 * 6/2018 Sanchez ..... D03D 13/00
10,254,498 B2 * 4/2019 Bedingfield ..... D03D 1/04
10,448,680 B2 * 10/2019 Howland ..... A41H 42/00
10,472,748 B2 * 11/2019 Mondal ..... D04B 1/16
10,480,107 B2 * 11/2019 Schindzielorz ..... D03D 15/12
2001/0009832 A1 * 7/2001 Shaffer ..... D03D 15/12 442/181
2003/0228821 A1 * 12/2003 Zhu ..... D02G 3/442 442/197
2004/0266978 A1 * 12/2004 Honda ..... C08G 63/85 528/279
2005/0235466 A1 * 10/2005 Segawa ..... A44B 19/34 24/396
2010/0255270 A1 * 10/2010 Stuebiger ..... B32B 5/26 428/201
2011/0086225 A1 * 4/2011 Takagi ..... D01F 6/62 428/401
2011/0098379 A1 * 4/2011 Lin ..... C08J 3/226 523/351
2012/0015575 A1 * 1/2012 Fuchs ..... C08F 220/18 442/79
2013/0185903 A1 * 7/2013 Matsuzawa ..... D03D 15/12 24/415
2017/0321355 A1 * 11/2017 Schindzielorz ..... D03D 1/02
2019/0021407 A1 * 1/2019 Howland ..... D03D 1/0088
2019/0301059 A1 * 10/2019 Flack ..... D03D 15/12

FOREIGN PATENT DOCUMENTS

JP 3716972 11/2005
KR 2004086050 3/2018

OTHER PUBLICATIONS

Patent Cooperation Treaty PCT International Search Report, dated Oct. 21, 2019. International Application No. PCT/US2019/023316. International Filing Date: Mar. 21, 2019.

* cited by examiner

*Primary Examiner* — Robert H Muromoto, Jr.
(74) *Attorney, Agent, or Firm* — Cheryl J. Brickey

(57) ABSTRACT

A flame resistant textile containing a plurality of warp yarns in a warp direction of the textile interwoven with a plurality of weft yarns in the weft direction approximately perpendicular to the warp direction. The warp yarns contain inherent FR polyester yarns having between about 1500 and 3500 ppm of a phosphorous based FR chemistry and the weft yarns contain polyester yarns. the textile contains more weft yarns by weight than warp yarns and wherein the FR textile contain about 1500 ppm or less of the phosphorous based FR chemistry.

18 Claims, No Drawings

FLAME RESISTANT TEXTILE

RELATED APPLICATIONS

This patent application claims priority to co-pending U.S. provisional patent application 62/649,655 filed on Mar. 29, 2018, which is herein incorporated by reference in its entirety.

FIELD OF THE INVENTION

The present invention generally relates to flame resistant fabrics, more particularly to flame resistant textile containing inherent flame resistant polyester yarns.

BACKGROUND

Many areas, such as hospitals and other commercial buildings, require flame resistant (FR) textiles to be used for articles such as bedding, upholstered furniture, curtains and the like. Recently, these institutions have desired to reduce the use of harmful chemicals (reducing their total usage or replacing them with less harmful options) while still maintaining the performance (FR and other characteristics) of the textiles. GREENSCREEN® developed by greenscreen-chemicals.org is one organization identifying chemicals of high concern and working to certify better alternatives. Thus, there is a need for a textile with good FR performance which has a low amount of phosphorous based FR chemistry.

BRIEF SUMMARY

A flame resistant textile containing a plurality of warp yarns in a warp direction of the textile interwoven with a plurality of weft yarns in the weft direction approximately perpendicular to the warp direction. The warp yarns contain inherent FR polyester yarns having between about 1500 and 3500 ppm of a phosphorous based FR chemistry and the weft yarns contain polyester yarns. the textile contains more weft yarns by weight than warp yarns and wherein the FR textile contain about 1500 ppm or less of the phosphorous based FR chemistry.

A flame resistant (FR) textile containing a plurality of warp yarns in a warp direction of the textile interwoven with a plurality of weft yarns in the weft direction approximately perpendicular to the warp direction. The weft yarns contain inherent FR polyester yarns having between about 1500 and 3500 ppm of a phosphorous based FR chemistry and the warp yarns contain polyester yarns. The textile contains more warp yarns by weight than warp yarns and the FR textile contains about 1500 ppm or less of the phosphorous based FR chemistry.

A process for forming a flame resistant (FR) textile containing obtaining a plurality of warp yarns inherent FR polyester yarns having between about 1500 and 3500 ppm of a phosphorous based FR chemistry, where the inherent FR polyester yarns were formed by the process of extruding molten polyester and the phosphorous based FR chemistry together and obtaining a plurality of weft yarns containing polyester yarns having less than about 100 ppm of a phosphorous based FR chemistry. The warp and weft yarns are woven such that the warp yarns are in the warp direction of the textile and the weft yarns are in the weft direction approximately perpendicular to the warp direction forming a woven textile, where the woven textile comprises more weft yarns by weight than warp yarns, and where the FR textile contains about 1500 ppm or less of the phosphorous based FR chemistry.

DETAILED DESCRIPTION

The flame resistant (FR) textile is a woven textile that provides FR properties using low levels of phosphorous based FR chemistry. Preferably, the FR textile passes one or more of the following FR tests: NFPA 701 v2015, California Title 19 fire test, and the Canadian ULC 109 ed. 3.

The FR textile may be any suitable textile, including a woven, knit or nonwoven. In one preferred embodiment, the textile is a woven fabric which contains a plurality of warp yarns in a warp direction of the textile which are interwoven with a plurality of weft yarns in the weft direction. The weft direction is defined to be approximately perpendicular to the warp direction. This woven textile can preferably be made using standard weaving machines. The weave pattern used for the FR textile may be any suitable weave pattern, including but not limited to plain, satin, twill, basket-weave, poplin, jacquard, and crepe weave fabric layers. Preferably, the FR textile is a plain weave textile.

In one embodiment, at least a portion of the warp yarns are inherent FR polyester (PET or polyethylene terephthalate) yarns. "Inherent" in this application means that the yarns (or fibers) were formed with the FR chemistries within them. Preferably, the FR chemistry was added to the molten polyester polymer and then was extruded out an extruder to form the yarns/fibers. Other ways of making fibers/yarns/textiles have FR properties is to treat the yarns/fibers/textiles with an FR chemistry after they were formed. A yarn or textile may have an FR chemistry coated onto it for enhanced FR performance. These treatments after the yarn/fiber are formed would not be considered inherent as defined in this application. Inherent FR fibers/yarns are sometimes looked at more favorability than surface treatments as they tend to be more wash durable and because the chemistry is within the yarns/fibers, less of the chemistry is available to interact with a user of the textile. Preferably, the FR textile is wash durable meaning that the fabric still meets the FR requirements after a minimum 30 washes using ASTM D5489.

In one embodiment, at least about 50% by number of the warp yarns are inherent FR polyester yarns, more preferably at least about 66% by number, more preferably at least about 90% by number. In another embodiment, essentially all (greater than 95% by number) of the warp yarns are inherent FR polyester yarns. In the embodiments where not all of the warp yarns are inherent FR polyester yarns, the "noninherent" warp yarns are preferably also polyester.

Preferably, the inherent FR polyester yarns contain a phosphorous based FR chemistry. In a preferred embodiment, the phosphorus is extruded in the yarn production process. It is a more environmentally friendly candidate for FR as many alternatives like brominated and halogenated chemistries are banned for indoor applications. The phosphorous based chemistry can be in the inherent FR polyester yarns in any suitable amount, preferably between about 1,500 and 3,500 ppm, more preferably between about 1,500 and 2,500 ppm. In some embodiment, the FR polyester yarns a phosphorous concentration of less than 3,500 ppm, more preferably less than 2,500 ppm, more preferably less than 2,200 ppm. In another embodiment, the FR polyester yarns a phosphorous concentration of at least about 100 ppm, more preferably at least about 800, more preferably at least about 1,000 ppm, more preferably at least about 1,500 ppm.

The weft yarns may be any suitable yarn, preferably polyester. In one preferred embodiment, essentially none (defined in this application to be less than 5% by number) of the weft yarns are inherent FR polyester yarns. Sometimes while testing yarns for phosphorous, yarns that do not intentionally contain phosphorous may have very low level readings of phosphorous from contamination from other textiles or from the testing equipment. Phosphorus-free, in this application, is defined to mean a ppm measurement of phosphorus of less than about 6 ppm. Preferably, these non-inherent FR yarns contain no or essentially no FR chemistries. In one embodiment, the weft yarns contain less than about 100 ppm of the phosphorous based FR chemistry. In one embodiment, at least 50% by number of the polyester weft yarns comprise less than 100 ppm of the phosphorous based FR chemistry. In another embodiment, at least 90% by number of the polyester weft yarns comprise less than 100 ppm of the phosphorous based FR chemistry. In another embodiment, essentially all of the polyester weft yarns comprise less than 100 ppm of the phosphorous based FR chemistry. In one embodiment, the FR textile contains a mixture of inherent and noninherent FR yarns in the weft direction. In one embodiment, less than 40% by number of the weft yarns are inherent FR polyester yarns. In another embodiment, between about 1 and 35% by number of the weft yarns are inherent FR polyester yarns.

In one embodiment, the warp and/or weft yarns are made at least partially from recycled polyester. Using recycled polyester is preferred for environmental reasons. It has been shown that 100% post-consumer recycled yarn can be used for many applications. In another embodiment, all of the yarns in the FR textile contain polyester. This allows for easier recycling of the FR textile at the end of its life cycle. The yarns/fibers may be dyed or colored prior to weaving in yarn/fiber form, or may be dyed after the textile is woven.

The FR textile, in one embodiment, is weft heavy meaning that the textile contains more weft yarns by weight than warp yarns. Preferably, the FR textile contains at least about 51% by weight weft yarns. The FR textile contains about 1,500 ppm or less of the phosphorous based FR chemistry, more preferably less than about 1,000 ppm of the phosphorous based FR chemistry. In another embodiment, the FR textile contains about 800 ppm or less of the phosphorous based FR chemistry. This ppm is of the entire textile as a whole (for example, if all of the warp yarns contained 2,000 ppm, the weft yarns contained 0 ppm, and the textile contained 50% by weight of warp and weft yarns, then the FR textile would have as a whole 1,000 ppm). GREEN-SCREEN® for Safer Chemicals is a method for chemical hazard assessment designed to identify chemicals of high concern and safer alternatives. It is used by industry, government and NGOs (non-government organizations) to support product design and development, materials procurement, and as part of alternatives assessment to meet regulatory requirements. Any FR chemical at 1,000 ppm or less poses less chance of VOC off gasing. To be GREEN-SCREEN® certified, the FR chemicals in the textile (as a whole) must be less than 1,000 ppm.

In another embodiment, the ppm of all FR treatments (including both the phosphorous based FR chemistry as well as other inherent and topically applied FR chemistries) are less than about 1,500 ppm, more preferably less than 1,000 ppm, more preferably less than about 800 ppm.

Preferably, the warp and weft yarns have an average DCMC of less than about 0.6. The test method for shade is ASTM1729-89 and AATCC EP6. This is important because the yarns cannot be used intermittently across the warp or fill directions due to shade changes between the FR and non FR yarns. The overall shade needs to be consistent across both fabric directions.

The FR textile can be used for any suitable end use, preferably as bed linens, draperies, clothing, and upholstered furniture. In one embodiment, the FR textile is used for privacy curtains or room dividers in health care settings.

In another embodiment, the FR textile is warp heavy meaning that the textile contains more warp yarns by weight than weft yarns. Preferably, the FR textile contains at least about 51% by weight warp yarns. In this embodiment, at least about 50% by number of the weft yarns are inherent FR polyester yarns, more preferably at least about 66% by number, more preferably at least about 90% by number. In another embodiment, essentially all (greater than 95% by number) of the weft yarns are inherent FR polyester yarns. Also in this embodiment, the warp yarns may be any suitable yarn, preferably polyester. In one preferred embodiment, essentially none (less than 5% by number) of the warp yarns are inherent FR polyester yarns. In one embodiment, at least 50% by number of the warp yarns comprise less than 100 ppm of the phosphorous based FR chemistry. In another embodiment, at least 90% by number of the warp yarns comprise less than 100 ppm of the phosphorous based FR chemistry.

Preferably, the FR textile is subjected at additional steps after weaving the textile. In one embodiment, the FR textile is subjected to heat and/or water after weaving. While not being bound to any theory, it is believed that the post treatment using heat and/or water removes some of the contaminants or weaving processing aids from the yarns and textile and improves the FR characteristics as less flammable materials are available on the textile.

After weaving, the FR textile may be colored using disperse dyes or cationic dyes (or a combination of both). It is preferred to use disperse and cationic dyes for polyester yarns.

Additional finishes may be also added after weaving including anti-microbial treatments, durable water repellents (DWR) finishes, preferably those formulations not including fluorine, and additional topical FR treatments. One example of DWR for water repellency without fluorine is a plant based chemistry derived from palm oil. Further finishes may include topical phosphorus chemistry that can be applied in the dye jet and on the tenter in finishing (preferably at 1,000 ppm or less).

Example 1

The fabric of example 1 was a plain weave product. The fabric contained 116 ends per inch (warp) of 150 d multifilament polyester (PET) and 60 picks per inch (weft) of 300 d multifilament polyester. The PET picks contained approximately 3000 ppm of a phosphorous based FR material. The PET ends contained no intentionally added phosphorous based FR material.

The fabric of example 1 was found to include 1,521 ppm of the phosphorous based FR material. The fabric passed the NFPA 701 v2015 FR test, but failed to gain GREEN-SCREEN® certification as the phosphorus in the fabric exceeded 1,000 ppm.

Example 2

The fabric of example 2 had the same construction as the fabric of example 1, except that none of the of the PET fibers (ends or picks) contained any intentionally added phosphorous based FR material.

The fabric of example 2 was found to include 1.7 ppm of the phosphorous based FR material (this trace amount is believed to be from a slight sample or testing equipment contamination). The fabric failed the NFPA 701 v2015 FR test.

Example 3

The fabric of example 3 had the same construction as the fabric of example 1, except that PET ends contained approximately 2000 ppm of a phosphorous based FR material and the PET picks contained no intentionally added phosphorous based FR material.

The fabric of example 3 was found to include 980 ppm of the phosphorous based FR material. The fabric passed both the NFPA 701 v2015 FR test and gained GREENSCREEN® certification as the phosphorus in the fabric was less than 1,000 ppm.

As one can see from the examples, it is difficult to pass both the NFPA 701 v2015 FR test and gain GREENSCREEN® certification (phosphorus less than 1,000 ppm). Based on previous fabrics, it was believed that it was typically required to have at least about 3,000 ppm phosphorous to pass the FR test.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A flame resistant (FR) textile comprising a plurality of warp yarns in a warp direction of the FR textile interwoven with a plurality of weft yarns in the weft direction approximately perpendicular to the warp direction, wherein greater than 95% by number of the warp yarns are inherent FR polyester yarns having between about 1500 and 3500 ppm of a FR chemistry comprising phosphorous, wherein the weft yarns comprise polyester yarns, wherein the FR textile comprises more weft yarns by weight than warp yarns, and wherein the FR textile comprises about 1000 ppm or less of the FR chemistry.

2. The FR textile of claim 1, wherein at least 90% by number of the polyester weft yarns comprise less than 100 ppm of the FR chemistry.

3. The FR textile of claim 1, wherein the FR textile comprises at least about 51% by weight weft yarns.

4. The FR textile of claim 1, wherein the FR textile passes at least one of the NFPA 701 v2015, California Title 19 fire test, and Canadian ULC 109 ed. 3 tests.

5. The FR textile of claim 1, wherein the FR textile is wash durable for at least 30 washes defined as ASTM D5489 industrial laundry method and still passing NFPA 701 v2015.

6. The FR textile of claim 1, further comprising a durable water repellent, fluorine-free, flame resistant treatment.

7. An FR textile article comprising the FR textile of claim 1.

8. A flame resistant (FR) textile comprising a plurality of warp yarns in a warp direction of the FR textile interwoven with a plurality of weft yarns in the weft direction approximately perpendicular to the warp direction, wherein greater than 95% by number of the weft yarns are inherent FR polyester yarns having between about 1500 and 3500 ppm of a FR chemistry comprising phosphorous, wherein the warp yarns comprise polyester yarns, wherein the FR textile comprises more warp yarns by weight than weft yarns, and wherein the FR textile comprises about 1000 ppm or less of the FR chemistry.

9. The FR textile of claim 8, wherein at least 90% by number of the polyester warp yarns comprise less than 100 ppm of the FR chemistry comprising phosphorous.

10. The FR textile of claim 8, wherein the FR textile comprises at least about 51% by weight warp yarns.

11. The FR textile of claim 8, wherein the FR textile passes at least one of the NFPA 701 v2015, California Title 19 fire test, and Canadian ULC 109 ed. 3 tests.

12. An FR textile article comprising the FR textile of claim 8.

13. A process for forming a flame resistant (FR) textile comprising:

obtaining a plurality of warp yarns being inherent FR polyester yarns having between about 1500 and 3500 ppm of a FR chemistry comprising phosphorous, wherein the inherent FR polyester yarns were formed by the process of extruding molten polyester and the FR chemistry together;

obtaining a plurality of weft yarns comprising polyester yarns having less than about 100 ppm of the FR chemistry;

weaving the warp yarns and the weft yarns such that the warp yarns are in the warp direction of the FR textile and the weft yarns are in the weft direction approximately perpendicular to the warp direction forming a woven textile, wherein the woven textile comprises more weft yarns by weight than warp yarns, wherein greater than 95% by number of the warp yarns of the FR textile are inherent FR polyester yarns, and wherein the FR textile comprises about 1000 ppm or less of the FR chemistry.

14. The FR textile of claim 13, wherein essentially all of the polyester weft yarns comprise less than 100 ppm of the FR chemistry.

15. The FR textile of claim 13, wherein the FR textile comprises at least about 51% by weight weft yarns.

16. The FR textile of claim 13, wherein the FR textile passes at least one of the NFPA 701 v2015, California Title 19 fire test, and Canadian ULC 109 ed. 3 tests.

17. The FR textile of claim 13, wherein the FR textile is wash durable for at least 30 washes defined as ASTM D5489 industrial laundry method and still passing NFPA 701 v2015.

18. The FR textile produced by the process of claim 13.

* * * * *